US011485461B2

(12) United States Patent
Latham

(10) Patent No.: US 11,485,461 B2
(45) Date of Patent: Nov. 1, 2022

(54) DEVICE AND METHOD FOR LAUNCHING AND RECOVERING AN UNMANNED UNDERWATER VEHICLE

(71) Applicant: Tridentis Advanced Marine Vehicles, LLC, Kailua Kona, HI (US)

(72) Inventor: William Latham, Stafford, VA (US)

(73) Assignee: Tridentis Advanced Marine Vehicles, LLC, Kailua Kona, HI (US)

( * ) Notice: Subject to any disclaimer, the term of this patent is extended or adjusted under 35 U.S.C. 154(b) by 0 days.

(21) Appl. No.: 17/201,491

(22) Filed: Mar. 15, 2021

(65) Prior Publication Data

US 2022/0289347 A1 Sep. 15, 2022

(51) Int. Cl.

| | |
|---|---|
| ***B63C 7/16*** | (2006.01) |
| ***B63G 8/00*** | (2006.01) |
| ***B63C 7/24*** | (2006.01) |
| ***B63B 27/12*** | (2006.01) |
| *B63B 27/16* | (2006.01) |

(52) U.S. Cl.

CPC ..... *B63C 7/16* (2013.01); *B63B 27/12* (2013.01); *B63C 7/24* (2013.01); *B63G 8/001* (2013.01); *B63B 2027/165* (2013.01); *B63G 2008/002* (2013.01)

(58) Field of Classification Search

CPC ..... B66C 3/04; B66C 13/02; B63B 2027/165; B63B 27/12; B63C 7/20; B63C 7/16; B63C 7/24

See application file for complete search history.

(56) References Cited

U.S. PATENT DOCUMENTS

| | | | | |
|---|---|---|---|---|
| 1,590,020 | A * | 6/1926 | Golden | B63C 7/20 294/111 |
| 3,472,191 | A * | 10/1969 | Horton | B63C 7/20 114/52 |
| 3,733,101 | A * | 5/1973 | Sayre, Jr. | B63C 7/20 294/104 |
| 4,444,425 | A * | 4/1984 | Miller | B66C 1/62 294/206 |
| 8,096,254 | B1 | 7/2012 | Bauer et al. | |
| 8,590,476 | B2 | 11/2013 | Goudeau et al. | |
| 10,351,212 | B2 | 7/2019 | Jourdan et al. | |
| 2009/0308299 | A1 | 12/2009 | Luccioni et al. | |
| 2019/0263481 | A1 * | 8/2019 | Brink | B63B 27/16 |

FOREIGN PATENT DOCUMENTS

| | | | | |
|---|---|---|---|---|
| CN | 112278197 A * | 1/2021 | | |
| WO | WO-2004065206 A1 * | 8/2004 | | B63C 7/20 |

* cited by examiner

*Primary Examiner* — Andrew Polay
(74) *Attorney, Agent, or Firm* — Greer, Burns & Crain, Ltd.

(57) ABSTRACT

Devices and methods for recovering an unmanned underwater vehicle. The device includes a gantry mounted on a recovery vehicle, a frame, and a shaft extending between the gantry and the frame and configured to vertically move the frame relative to the gantry. Attached to the frame are a plurality of rotatable arms movable between an opened position and a closed position. A first end of each arm is attached to the frame at a pivot. A flexible strap extends between each of the second ends of the arm and the frame. As the arms are moved to the closed position around the unmanned underwater vehicle, the straps will support the unmanned underwater vehicle.

20 Claims, 4 Drawing Sheets

DEVICE AND METHOD FOR LAUNCHING AND RECOVERING AN UNMANNED UNDERWATER VEHICLE

STATEMENT REGARDING FEDERALLY SPONSORED RESEARCH OR DEVELOPMENT

This invention was made with government support under the Design of an Autonomous Coastal Monitor WC133R18CN0086 awarded by the National Oceanographic and Atmospheric Agency. The government may have certain rights in the invention.

FIELD OF THE INVENTION

The present invention relates to an unmanned vehicle launch and recovery system, and more specifically, to a device for launching and recovering an unmanned underwater vehicle.

BACKGROUND OF THE INVENTION

Unmanned underwater vehicles (UUVs) encompass both vehicles which are controlled remotely by an operator and autonomous vehicles which operate independently of an operator. Both types of UUVs are beneficial for a variety of applications including scientific applications, commercial offshore applications, and military applications. For example, a glider is a UUV that may be remotely controlled or operate autonomously.

Typically, recovery vehicles utilize large cranes, nets, or stern gate ramps for launching and recovering UUVs. This process is often dangerous to the ship's crew that has to perform the launch and recovery and is severely limited to ocean conditions that are benign. Compared with the UUVs, the recovery vehicles are usually much larger vehicles. More recently, smaller recovery vehicles have been utilized in order to reduce the operational expenses and danger associated with recovering an UUV.

While presumably effective for their intended purposes, current recovery devices often require a precise positioning of the UUV relative to recovery device and specific weather conditions in order to avoid damaging the UUV. Additionally, some current recovery devices are designed for specific UUVs, and therefore are only able to safely recover specific UUVs.

Accordingly, it would be desirable to provide a device which allows for the launch and recovery of UUVs but without requiring precise positioning or specific environmental conditions. Additionally, it would be further desirable to provide a device that is able to recover and launch differently sized and shaped UUVs. Finally, it would be desirable to provide a device that addresses these problems with a relatively small surface vessel, or even an unmanned surface vessel.

SUMMARY OF THE INVENTION

A new device for recovering and launching an unmanned underwater vehicles (UUVs) and methods for recovering and launching a UUV have been invented. According to the present embodiments, the recovery utilizes a soft capture which does not require exact positioning for recovery and can be utilized to recovery UUVs with different sizes and/or shapes. The soft capture is made possible by the use of flexible straps on arms. The straps adjust and react to the UUV as the arms close around the UUV. Advantageously, the device can be mounted to an unmanned surface vehicle.

Accordingly, in an aspect of the present invention, the present invention may be generally characterized as providing a device for recovering an unmanned underwater vehicle. The device includes a gantry mounted on a recovery vehicle, a frame, and a shaft extending between the gantry and the frame, the shaft configured to vertically displace the frame relative to the gantry. The frame includes a plurality of arms and a plurality of flexible straps. Each arm has a first end and a second end opposite the first end, and each arm is attached to the frame at a pivot and rotatable about the pivot between an opened configuration and a closed configuration. Each flexible strap extends from the frame to a second end of one of the arms from the plurality of arms.

The arms from the plurality of arms may be curved.

The arms from the plurality of arms may be independently rotatable.

The device may include a cradle. The cradle may be mounted to the frame and have a surface configured to contact the unmanned underwater vehicle.

The device may include a strap tensioner. The strap tensioner may be attached on the frame to an end of one of the straps.

The device may further include a piston attached to an arm from the plurality of arms. The piston may be configured to rotate said arm. The piston may be mounted on the frame.

The arms from the plurality of arms may be arranged in pairs. Accordingly, each pair may include a first arm on a first side of the frame and a second arm on the second side of the frame.

In another aspect, the present invention may be characterized, broadly, as providing a recovery vehicle configured to recover an unmanned unwater vehicle. The recovery vehicle includes a gantry mounted to the recovery vehicle, a frame, and a shaft extending between the gantry and the frame. The shaft may be configured to vertically displace the frame relative to the gantry. The frame includes a plurality of arms and a plurality of flexible straps. Each arm has a first end and a second end opposite the first end. Each arm may be attached to the frame at a pivot and rotatable about the pivot between an opened configuration and a closed configuration. The arms from the plurality of arms may be arranged in pairs and each pair may include a first arm on a first side of the frame and a second arm on the second side of the frame. Each flexible strap may extend from the frame to a second end of one of the arms from the plurality of arms.

The arms from the plurality of arms may have a U-shape.

The arms from the plurality of arms may be independently rotatable.

The frame may include a beam having a first end and a second end opposite the first end.

The first end of the frame and the second end of the frame may each include a cradle having an outer surface.

The device may further include a strap tensioner mounted on the frame. The strap tensioner may be attached to an end of one of the straps.

The device may further include a piston attached to an arm from the plurality of arms. The piston may be configured to rotate said arm. The piston may be mounted on the frame.

In a further another aspect, the present invention may be characterized, generally, as providing a method for recovering an unmanned underwater vehicle by:

positioning a gantry above an unmanned underwater vehicle;

lowering a frame downward away from the frame and towards the unmanned underwater vehicle, the frame comprising a plurality of movable arms and wherein each arm comprises a flexible strap extending from the arm and the frame;

closing at least two arms from the plurality of movable arms around the unmanned underwater vehicle, wherein the unmanned underwater vehicle contacts the flexible straps of said at least two arms; and, lifting the frame upward towards the gantry, wherein the flexible straps of said at least two arms support the unmanned underwater vehicle while the unmanned underwater vehicle is lifted.

The method according to this aspect may further include selecting one or more arms from the plurality of movable arms to close. A number of arms selected to close may be lower than a number of arms in the plurality of movable arms.

The method according to this aspect may further include adjusting a tension on the flexible straps of said at least two arms.

The gantry may be mounted on a recovery vehicle. The recovery vehicle may be an unmanned surface vehicle. The method may further include creating at least one wired or wireless electrical connection between the recovery vehicle and the unmanned underwater vehicle after the frame is lifted upward towards the gantry and performing at least one recovery process on the unmanned underwater vehicle after the at least one wired or wireless electrical connection has been created. The at least one recovery process may be selected from a group consisting of: downloading data from the unmanned underwater vehicle; uploading data to the unmanned underwater vehicle; or providing electrical energy to the unmanned underwater vehicle.

In another aspect, the present invention, broadly, may be characterized as providing a method for launching and recovering an unmanned underwater vehicle from an unmanned surface vehicle by:

launching an unmanned underwater vehicle from an unmanned surface vehicle;

locating, by the unmanned surface vehicle, the unmanned underwater vehicle; and, recovering the unmanned underwater vehicle by the unmanned surface vehicle.

These and other aspects and embodiments of the present invention will be appreciated by those of ordinary skill in the art based upon the following description of the drawings and detailed description of the preferred embodiments.

BRIEF DESCRIPTION OF THE DRAWINGS

The attached drawings will make it possible to understand how the invention can be produced and practiced, in which.

DETAILED DESCRIPTION OF THE PREFERRED EMBODIMENTS

As mentioned above, a new device for recovering a UUV, and methods associated with same, have been invented. The device utilizes arms that allow for a soft capture which is less likely to damage the UUV and also allows for the recovery of differently shaped and sized UUV. In one particular advantageous embodiment, the device is mounted on an unmanned surface vehicle (USV) which can locate the UUV, recover the UUV from the water, and, after obtaining data or charging or otherwise communicating with the UUV, launch the UUV back into the water.

Accordingly, with reference the attached drawings, one or more embodiments of the present invention will now be described with the understanding that the described embodiments are merely preferred and are not intended to be limiting.

Figure 1:
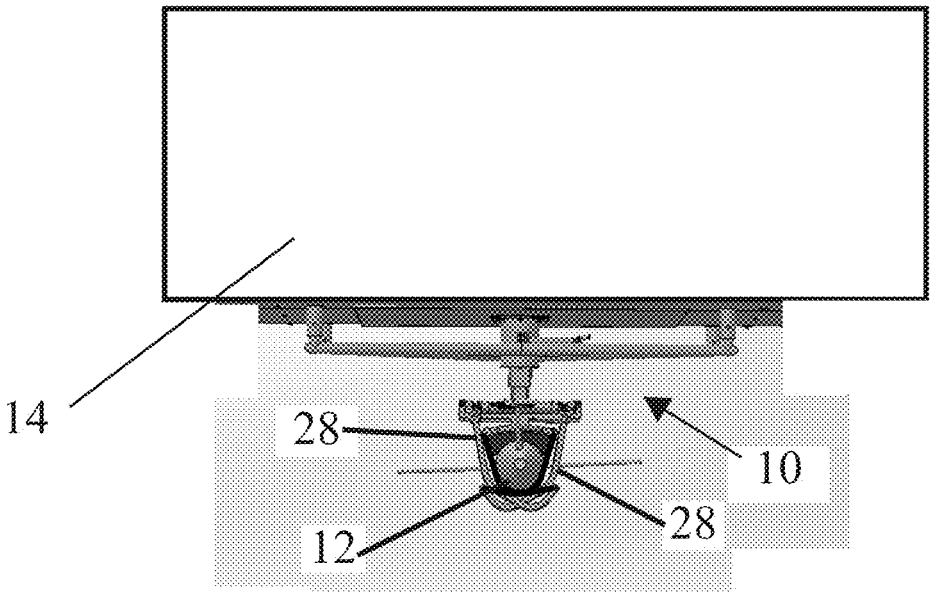
FIG. 1 is a front, elevational view of a device according to the present invention with a recovered UUV.
Figure 2:
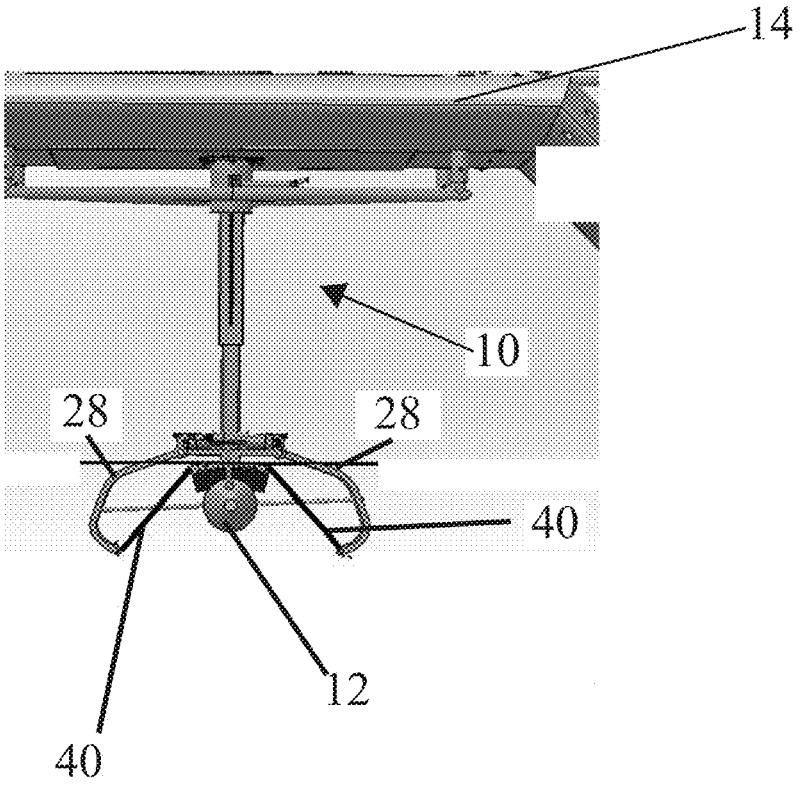
FIG. 2 is a front, elevational view of the device shown in FIG. 1 with a deployed UUV.

With reference to FIGS. 1 and 2, a device 10 for recovering a UUV 12 is depicted as mounted on a recovery vehicle 14, for example a USV. The mounting of the device 10 on the USV is merely preferred. In other words, according to the present invention, the device 10 may be mounted on any type of recovery vehicle 14, including a manned recovery vehicle.

Figure 3:
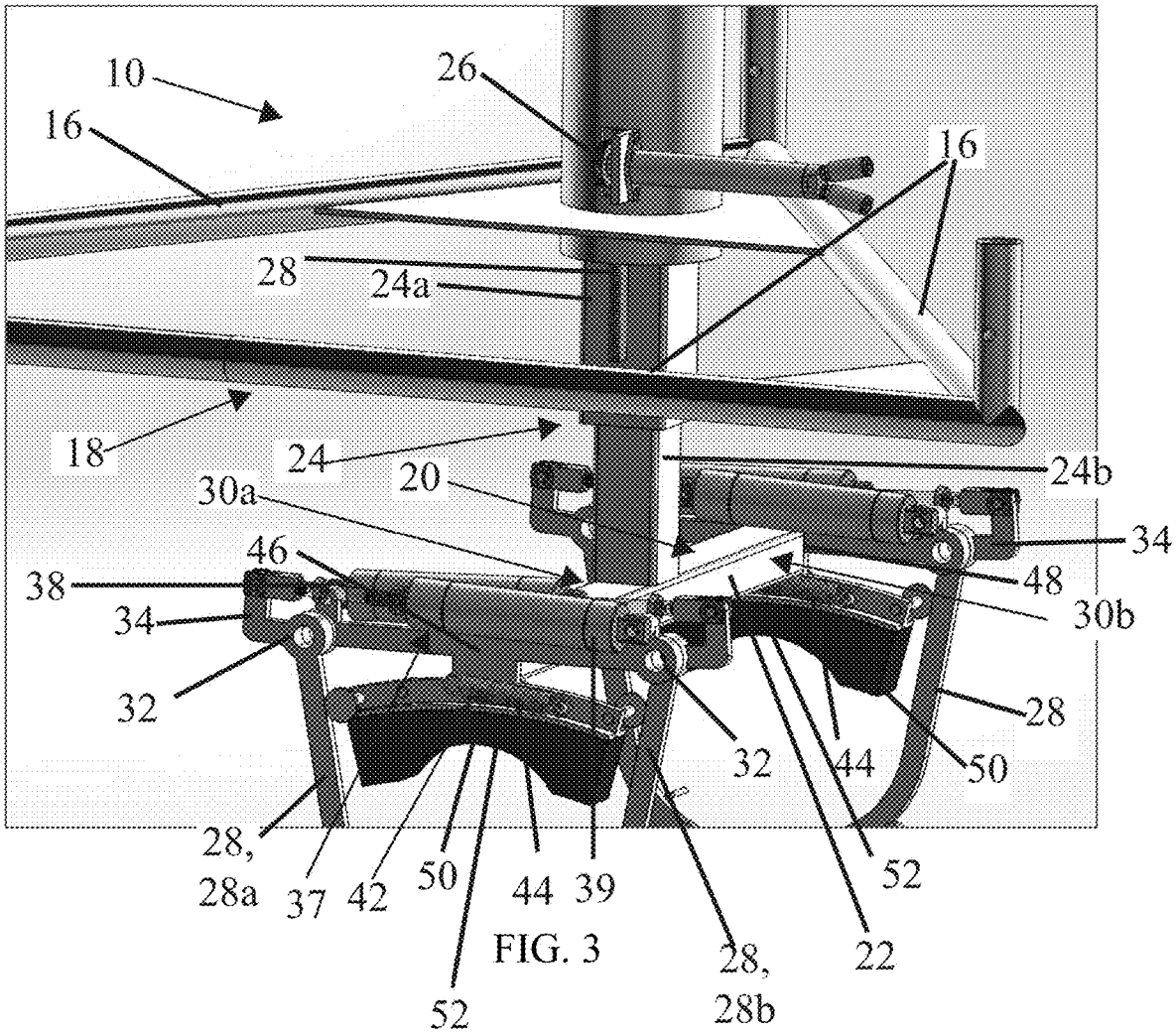
FIG. 3 is a front and side perspective view of the device shown in FIG. 1.
Figure 4:
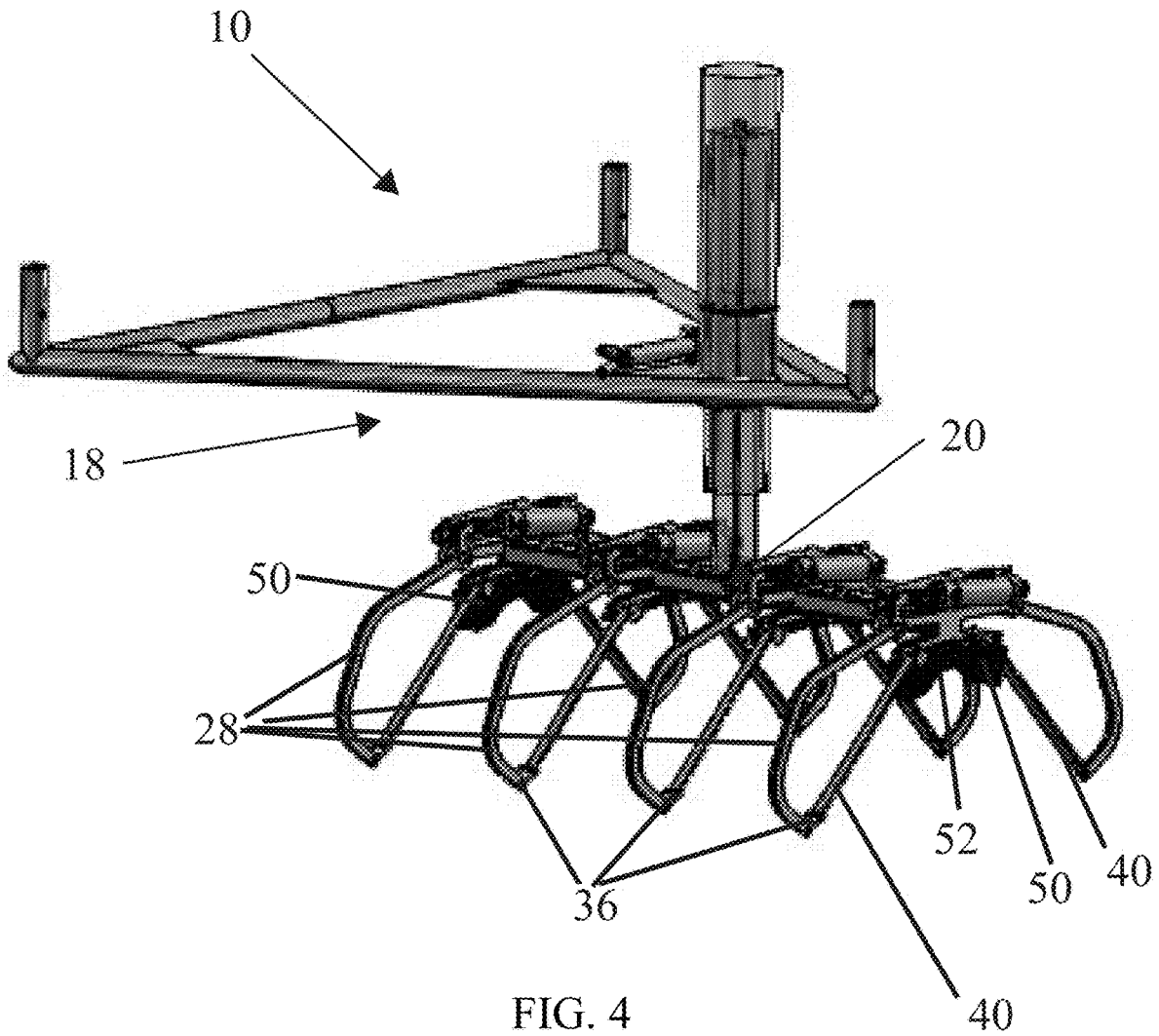
FIG. 4 is a front and side perspective view of another device according to the present invention.

As can be seen best in FIGS. 3 and 4, the device 10 includes a plurality of support members 16 which form a gantry 18 to mount the device 10 to the recovery vehicle 14. The support members 16 may be beams, rods, conduits, or other similar structures and may be made from a suitable material like stainless steel, aluminum, titanium, or a composite.

The device 10 further includes a frame 20. In the depicted embodiment, the frame 20 comprises an elongate beam 22. The beam 22 may be made from a suitable material like stainless steel, aluminum, titanium, or a composite.

A vertical shaft 24 extends between the gantry 18 and the frame 20 and secures the gantry 18 and the frame 20 together. The shaft 24 is configured to be vertically displaced in order to move the frame 20 relative to the gantry 18. Accordingly, in a preferred embodiment the shaft 24 includes an upper portion 24*a* and a lower portion 24*b*. The lower portion 24*b* is received inside of the upper portion 24*a*. The portions 24*a*, 24*b*, and the shaft 24 in general, may be displaced vertically by, for example, one or more gears or pinons 26 engaging racks mounted on the portions 24*a*, 24*b*. A motor (not shown) may be used to drive the gears 26 and may be controlled by a controller.

Secured to the elongate beam 22 are a plurality of arms 28. The arms 28 may be arranged in pairs in which each pair includes an arm 28*a* on a first side 30*a* of the frame 20 and a second arm 28*b* on the second side 30*b* of the frame 20. The number of arms 28 can vary. For example, in the embodiment of FIG. 3, there are four arms 28 (arranged into two pairs) and in the embodiment of FIG. 4, there are eight arms 28 (arranged into four pairs). The arrangement of the arms 28 in pairs is particularly advantageous to ensure that the UUV 12 remains balanced during recovery to avoid damaging the UUV 12. However, this is merely preferred and other numbers of arms 28 and arrangements of arms 28 may be utilized.

The arms 28 are preferably curved, most preferably having a U-shape. Each arm 28 is attached to the elongate beam 22 at a pivot 32 at or near a first end 34 of the arm 28. A second end 36 of the arm 28 is opposite the first end 34 along a length of the arm 28.

Each arm 28 is movable about its pivot 32 between an opened configuration (shown in FIGS. 2 and 4) and a closed configuration (shown in FIGS. 1 and 3). Preferably each arm 28, or pair of arms 28, is independently rotatable, so that each arm 28 or pair of arms 28 can be moved regardless of the other arms 28. This allows for only certain arms 28 or pair of arms 28 to be moved at various times.

More specifically, each arm 28 is associated with a piston 37 having a cylinder 39 that is secured to the frame 20. The first ends 34 of the arms 28 are secured to a rod 38 of the piston 37. The rod 38 moves between a retracted position (FIG. 2) and an extended position (FIG. 1), which will in turn move the arm 28 around the pivot 32 between the opened and closed configurations. The rods 38 of the pistons 37 can be moved via fluid (i.e., hydraulic fluid or compressed air) that is stored on the UUV 12 and driven by one or more pumps controlled by a controller (not shown) or by an electrical motor.

According to the various embodiments, in order for the arms 28 to support the UUV 12, a plurality of flexible straps 40 is provided. A flexible strap 40 from the plurality extends between each second end 36 of one of the arms 28 and the frame 20. The flexible straps 40 are made from material that is strong enough to support the UUV 12, but pliable enough to change shape as the arms 28 are closed about the UUV 12. Exemplary materials include woven materials like nylon, polyester, and polypropylene, as well as other materials like rubbers and elastomers.

The flexible straps 40 provide the device 10 with the ability to safely recover the UUV 12 with less need for exact positioning because the flexible straps 40 will center and orient the UUV 12 upon retrieval. Additionally, the flexible straps 40 will more evenly distribute the load of the UUV 12 and distribute the load over a larger area. The flexible straps 40 thus provide a cradle-like support which allows a soft capture of the UUV 12—meaning that rigid or stiff surfaces will not contact the UUV 12 during recovery.

It is preferred, though not required, that the tension of the flexible straps 40 can be fixed or adjusted. For example, a strap tensioner 42 like a spring 44 or other biased member may be secured or associated with the flexible strap 40 to allow for the tension of the flexible strap 40 to change or be adjusted.

The frame 20 may include other structures to aid in positioning and securing the UUV 12. For example, as depicted, a front end 46 and a rear end 48 of the beam 22 each include a cradle 50. The cradles 50 are made from an elastically deformable material and includes a semi-circular cut out with a surface 52 that is contacted by the UUV 12 during recovery.

The cradles 50 are provided for impact resistance and mitigation. Additionally, the cradles 50 allow the flexible straps to tighten against a complaint surface which limits skin loading on the UUV 12. Further the cradles 50 may be used to assist in centering the UUV 12 relative to the device 10 to ensure proper alignment.

One or more exemplary processes for recovering an autonomous underwater vehicle will now be described.

Initially, the recovery vehicle 14 will locate the UUV 12. The location can occur as a result of the recovery vehicle 14 being provide with coordinates of the UUV 12 or as a result of the recovery vehicle 14 following a search pattern.

To identify the UUV 12, the recovery vehicle 14 can use machine vision, object recognition, object tracking. Accordingly, the recovery vehicle 14 may be equipped with one or more monitoring components including cameras, sensors, measurement devices, data capture devices or data transmission devices. Additionally, once the recovery vehicle 14 has identified the UUV 12, the recovery vehicle may also determine an orientation of the UUV 12. This may also occur via machine vision or object spatial recognition.

Once the UUV 12 has been identified and its orientation determined, the process may include a step of determine a route to reach the UUV 12. In addition to reaching the UUV 12, the route may include movements designed to provide the recovery vehicle 14 with a desired orientation relative to the orientation of the UUV 12 for recovery.

The recovery vehicle 14 may then proceed along the desired route while performing a repetitive analysis to ensure that the route is still the desired or most desired route. This can include constant use of machine vision, object spatial recognition, and/or object tracking. Eventually, the recovery vehicle 14 will be positioned in the desired position and the UUV 12 can be recovered.

Accordingly, when the gantry 18 is positioned above the UUV 12 or in another desired positioned, the frame 20 can be lowered. Preferably, the arms 28 are in the opened configuration when the frame 20 is first lowered, but if they are not, the arms 28 can be pivoted to the opened position.

As the frame 20 moves downward, or once the frame 20 has reached its lowest point, at least two of the arms 28 can be closed around the UUV 12. Eventually, the flexible straps 40 will contact the UUV 12 and the shape of the flexible straps 40 will change or adjust as result of the contact.

In some embodiments, less than all of the arms 28 will close around the UUV 12. Accordingly, the processes may include recognizing a size or type of the UUV 12, and then selecting the appropriate number or arrangement of arms 28 necessary for recovering the UUV 12. Based on this recognition only some of the arms 28 may be moved to the closed configuration around the UUV, and the remaining arms 28 may remain in the opened configuration.

The process may also include a step of adjusting a tension of the straps 40. This may occur in response to the recognizing of a size and type of the UUV 12, or it may occur automatically. Therefore, the adjustment of the tension may occur before the flexible straps 40 contact the UUV 12, or as the flexible straps 40 contact the UUV 12.

Eventually, the arms 28 will be rotated to the closed position, which the UUV 12 is supported by the straps 40. Accordingly, the frame 20 may be raised upward towards the gantry 18 to remove the UUV 12 from the water. The UUV 12 may be raised to a level which allow the recovery vehicle 14 to perform one or more recovery processes on the UUV 12.

Accordingly, although not depicted as such the recovery vehicle 14 includes one or more transceivers, transmitters, receivers, ports, connectors, chargers, and other devices that allow for both wired and unwired electrical connection and communication between the UUV 12 and the recovery vehicle 14 and allow for a recovery process to be performed. For example, data can be uploaded from the UUV 12 to the recovery vehicle 14 or another device in communication with the UUV 12 via the recovery vehicle 14. Additionally, data can be downloaded to the UUV 12 from the recovery vehicle 14 or another device in communication with the UUV 12 via the recovery vehicle 14. Similarly, the recovery vehicle 14 can provide electrical energy to the UUV 12 to charge batteries on the UUV 12.

Thus, the process may include creating at least one electrical connection between the recovery vehicle 14 and the UUV 12. The electrical connection may be a wired or a wireless connection, such as GSM, CDMA, Wi-Fi, WiMAX, Bluetooth. Once the electrical connection is established, at least one recovery process may be performed on the UUV 12. Again, by "recovery process" it is meant that data is exchanged between the UUV 12 and the recovery vehicle 14

(or another computer/controller) and/or energy is transferred between the UUV 12 and the recovery vehicle 14.

To deploy the UUV 12, either after it has been recovered or for an initial deployment, the frame 20 may be lowered downward away from the gantry 18. Once the frame 20 has reached its end of travel, the arms 28 that are closed around the UUV 12 may be moved to the opened configuration and the UUV 12 will be released.

In sum, the present invention provides devices and methods for recovering a UUV with a soft capture technique which does not require exact positioning for recovery and can be utilized to recover UUVs with different sizes and/or shapes.

The devices described and process described herein may utilize a controller or a computing device comprising a processing and a memory which has stored therein computer-executable instructions for implementing the processes described herein. The controller or a computing device may be any suitable devices configured to cause a series of steps to be performed so as to implement the various methods or steps such that instructions, when executed by the computing device or other programmable apparatus, may cause the functions/acts/steps specified in the methods described herein to be executed. The processing unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by the controller or a computing device.

The methods and steps described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems for recovering and/or deploying a UUV described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A device for recovering an unmanned underwater vehicle, the device comprising:

a gantry mounted on a recovery vehicle;

a frame comprising a plurality of arms, each arm having a first end and a second end opposite the first end, and each arm attached to the frame at a pivot and rotatable about the pivot between an opened configuration and a closed configuration, and, a plurality of flexible straps, each flexible strap extending from the frame to a second end of one of the arms from the plurality of arms; and, a shaft extending between the gantry and the frame, the shaft configured to vertically displace the frame relative to the gantry.

2. The device of claim 1, wherein the arms from the plurality of arms are curved.

3. The device of claim 1, wherein the arms from the plurality of arms are independently rotatable.

4. The device of claim 1, wherein the frame further comprises a cradle having a surface configured to contact the unmanned underwater vehicle.

5. The device of claim 1, wherein the frame further comprises a strap tensioner, the strap tensioner attached to an end of one of the straps.

6. The device of claim 1, wherein the frame further comprises a piston attached to an arm from the plurality of arms, and the piston configured to rotate said arm.

7. The device of claim 1, wherein the arms from the plurality of arms are arranged in pairs, each pair having a first arm on a first side of the frame and a second arm on the second side of the frame.

8. A recovery vehicle configured to recover an unmanned unwater vehicle, the recovery vehicle comprising:

a gantry mounted to the recovery vehicle;

a frame comprising a plurality of arms, each arm having a first end and a second end opposite the first end, and each arm attached to the frame at a pivot and rotatable about the pivot between an opened configuration and a closed configuration, wherein the arms from the plurality of arms are arranged in pairs, each pair having a first arm on a first side of the frame and a second arm on the second side of the frame, and, a plurality of flexible straps, each flexible strap extending from the frame to a second end of one of the arms from the plurality of arms; and, a shaft extending between the gantry and the frame, the shaft configured to vertically displace the frame relative to the gantry.

9. The recovery vehicle of claim 8, wherein the arms from the plurality of arms have a U-shape.

10. The recovery vehicle of claim 8, wherein the arms from the plurality of arms are independently rotatable.

11. The recovery vehicle of claim 8, wherein the frame comprises a beam having a first end and a second end opposite the first end.

12. The recovery vehicle of claim 8, wherein the first end of the frame and the second end of the frame each comprise a cradle having an outer surface.

13. The recovery vehicle of claim 8, wherein the frame further comprises a strap tensioner, the strap tensioner attached to an end of one of the straps.

14. The recovery vehicle of claim 8, wherein the frame further comprises a piston attached to an arm from the plurality of arms, and the piston configured to rotate said arm.

15. A method for recovering an unmanned underwater vehicle, the method comprising:

positioning a gantry above an unmanned underwater vehicle;

lowering a frame downward away from the frame and towards the unmanned underwater vehicle, the frame comprising a plurality of movable arms and wherein each arm comprises a flexible strap extending from the arm and the frame;

closing at least two arms from the plurality of movable arms around the unmanned underwater vehicle, wherein the unmanned underwater vehicle contacts the flexible straps of said at least two arms; and, lifting the frame upward towards the gantry, wherein the flexible straps of said at least two arms support the unmanned underwater vehicle while the unmanned underwater vehicle is lifted.

16. The method of claim 15, further comprising:

selecting one or more arms from the plurality of movable arms to close, wherein a number of arms selected to close is lower than a number of arms in the plurality of movable arms.

17. The method of claim 15, further comprising:

adjusting a tension on the flexible straps of said at least two arms.

18. The method of claim 15, wherein the gantry is mounted on a recovery vehicle.

19. The method of claim 18, the recovery vehicle is an unmanned surface vehicle.

20. The method of claim 18, further comprising:

creating at least one wired or wireless electrical connection between the recovery vehicle and the unmanned underwater vehicle after the frame is lifted upward towards the gantry; and, performing at least one recovery process on the unmanned underwater vehicle after the at least one wired or wireless electrical connection has been created, wherein the at least one recovery process is selected from a group consisting of: downloading data from the unmanned underwater vehicle; uploading data to the unmanned underwater vehicle; or providing electrical energy to the unmanned underwater vehicle.

* * * * *